United States Patent [19]

Kessler

[11] Patent Number: 4,534,094

[45] Date of Patent: Aug. 13, 1985

[54] METHOD OF MAKING AN INK ROLLER ASSEMBLY WITH CAPILLARY INK SUPPLY

[76] Inventor: John R. Kessler, 2060 D Sidneywood Dr., West Carrollton, Ohio 45449

[21] Appl. No.: 520,425

[22] Filed: Aug. 4, 1983

Related U.S. Application Data

[62] Division of Ser. No. 322,463, Nov. 18, 1981, Pat. No. 4,399,751.

[51] Int. Cl.[3] ..... B41F 1/46

[52] U.S. Cl. ..... 29/148.4 D; 29/125; 29/132; 29/130; 29/124; 118/258

[58] Field of Search ..... 29/148.4 D, 125, 132; 101/331, 329, 348; 118/258, DIG. 15

[56] References Cited

U.S. PATENT DOCUMENTS

| | | | |
|---|---|---|---|
| 277,154 | 5/1883 | Osborne | 29/125 |
| 2,663,257 | 12/1953 | Dudis | 29/121.6 X |
| 3,066,603 | 12/1962 | Talarico | 29/367 |
| 3,738,269 | 6/1973 | Wagner | 101/331 X |
| 4,207,818 | 6/1980 | Hamisch, Jr. | 101/348 |

*Primary Examiner*—Howard N. Goldberg
*Assistant Examiner*—John T. Burtch
*Attorney, Agent, or Firm*—Jacox & Meckstroth

[57] ABSTRACT

An ink applying sleeve of resilient micro-porous ink retaining material is confined between a pair of circular flanges mounted on a connecting support hub. A cylindrical ink retaining unit is also mounted on the center hub and is confined between the flanges to support the sleeve. The unit includes a stack of thin plastic discs which define concentric annular ink retaining capillary passages or chambers for receiving a supply of ink. The concentric chambers are interconnected by a series of radially extending passages which control the outward radial flow of ink from the concentric chambers into the micro-porous sleeve. In one form, the thin plastic discs are heat-formed from thin sheet plastics material and have a center hole for receiving the support hub.

7 Claims, 6 Drawing Figures

10
12
28
29
31
18
23
15
32
21
26
4
T

METHOD OF MAKING AN INK ROLLER ASSEMBLY WITH CAPILLARY INK SUPPLY

This is a division of application Ser. No. 322,463, filed Nov. 18, 1981, now U.S. Pat. No. 4,399,751.

BACKGROUND OF THE INVENTION

In the printing of pressure sensitive labels, for example, with a hand-held portable labeler of the type disclosed in U.S. Pat. No. 4,252,060 which issued to the Assignee of the present invention, it is common to apply ink to the selected printing characters on the endless printing bands or wheels with an ink roller. The ink roller may be of the type which incorporates a micro-porous ink retaining flexible sleeve mounted on a spool for rotation. A supply of ink is carried by the micro-porous sleeve so that the ink roller is capable of supplying sufficient ink to print one or more supply rolls of pressure sensitive labels.

In the printing of labels with characters or codes which are read by optical character recognition equipment, it is important for the printing to meet high quality standards. That is, the labels must be uniformly and precisely printed without a drop off or diminish in printing quality as the supply of ink is consumed from the microporous ink roller sleeve. Different forms of ink roller assemblies have been made or proposed in order to incorporate within the ink roller a larger supply of ink, for example, as disclosed in U.S. Pat. Nos. 2,663,257 and No. 3,738,269. Each of these patents disclose the use of capillary ink retaining passages or chambers within a surrounding band or sleeve of micro-porous ink retaining material.

In such an ink roller assembly, it is desirable to maximize the liquid ink storage capacity of the roller assembly while also providing for optimum flow rate control or metering of the ink from the storage reservoir or chambers to the application sleeve so that the ink applied by the sleeve remains substantially constant or uniform throughout the usable life of the roller assembly. It is also desirable to construct the ink roller assembly in a manner which prevents leakage of ink from the roller assembly in response to sudden changes in temperature or atmospheric pressure. After analyzing the ink roller assemblies disclosed in the above-mentioned patents, it is apparent that these ink roller assemblies do not provide all of the above desirable features.

SUMMARY OF THE INVENTION

The present invention is directed to an improved ink roller assembly which provides all of the desirable features mentioned above and, in addition, is inexpensive and simple in construction. More specifically, the roller assembly of the invention provides for maximizing the ink storage capacity of an ink roller assembly of predetermined size while also providing for a controlled flow rate or metering of the ink to the outer ink application surface of the sleeve in order to provide a substantially uniform or constant ink application rate which does not diminish as the ink supply is being consumed. The capillary action of the ink roller assembly of the invention also eliminates leakage of ink from the assembly when it is subjected to sudden changes in temperature and atmospheric pressure. Thus the ink roller assembly of the invention provides for high efficiency in the utilization of an internal ink supply and provides for precision ink dispensing in order to obtain continuous high quality printing of pressure-sensitive labels and other articles.

In accordance with one embodiment of the invention, an ink roller assembly includes a resilient and flexible sleeve of micro-porous ink retaining material. An ink retaining and reservoir unit is disposed within the sleeve and includes a stack of thin plastic discs each defining annular concentric capillary grooves or chambers for retaining a supply of ink. The ink is metered from the concentric capillary chambers into the porous ink retaining sleeve by a series of radially extending capillary grooves or passages formed within the discs. The capillary ink retaining unit and the surrounding ink retaining sleeve are confined between a set of circular flanges extending from a connecting hub which projects through center holes within the stack of discs.

Other features and advantages of the invention will be apparent from the following description, the accompanying drawing and the appended claims.

DESCRIPTION OF THE PREFERRED EMBODIMENT

Figures 1, 2, 3, 4, 5, 6:
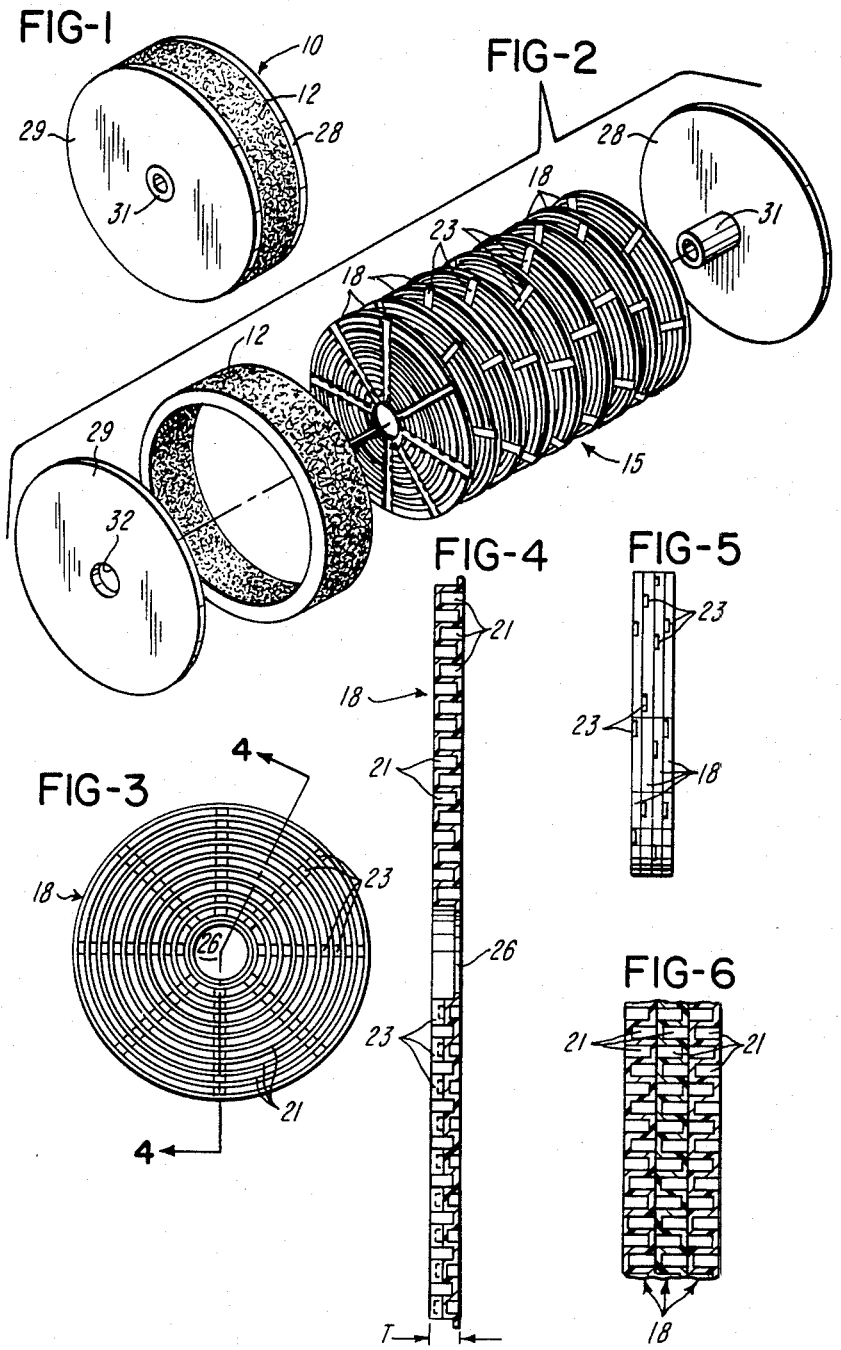
FIG. 1 is a perspective view of an ink roller assembly constructed in accordance with the present invention.
FIG. 2 is an exploded perspective view of the components which form the ink roller assembly shown in FIG. 1.
FIG. 3 is an enlarged side view of a thin formed plastic disc shown in FIG. 2.
FIG. 4 is a greatly enlarged radial section of an ink retaining disc as taken along the line 4—4 of FIG. 3.
FIG. 5 is an elevational view of four of the assembled discs shown in FIGS. 2–4.
FIG. 6 is an enlarged fragmentary radial section of three of the assembled discs.

FIG. 1 illustrates an ink roller assembly 10 which is constructed in accordance with the invention and which includes a sleeve 12 of flexible and resilient micro-porous ink retaining material. In one test sample of the assembly 10 which provided desirable ink application results, the sleeve 12 had an outer diameter of approximately 1.3 inch when assembled and a wall thickness of about 0.075 inch.

A cylindrical ink retaining unit 15 is disposed within the sleeve 12 which is stretched slightly onto the unit 15. The ink retaining unit 15 is formed by a plurality of thin annular discs 18 each of which is formed of a plastics material. As best shown in FIG. 4, each disc 18 may be formed from a sheet plastics material by vacuum forming a heated sheet to define a series of concentric annular grooves 21 on each side of the disc. As stated above, the disc illustrated in FIG. 4 is greatly enlarged. In the test sample, for example, each disc had an outer diameter of about 1.125 inch and an overall thickness T of about 0.040 inch. In this test sample, the sheet of thermoplastics material which was vacuum formed to produce each disc 18, had a thickness of about 0.010 inch, resulting in each annular groove 12 having a depth of about 0.030 inch.

As also shown in FIGS. 2–4, each of the capillary ink retention discs 18 has a plurality of peripherally spaced and radially extending capillary grooves or passages 23 which interconnect the grooves 21. While the passages 23 are shown on one side of each disc, the passages may be on both sides of each disc. Each of the grooves or passages 23 has a depth substantially smaller than the depth of the concentric grooves 21. For example, on the test sample, the passages 23 had a depth of about 0.005 inch. Each of the disc 18 also has a circular center opening or hole 26.

As illustrated in FIG. 2, a stack of the discs 18 forming the ink retaining unit 15 is inserted into the sleeve 12 so that the sleeve 12 has a slight stretch fit around the outer cylindrical surface of the discs 18. The stack of discs 18 and the surrounding sleeve 12 are confined between a set of circular flanges 28 and 29 which are molded of a rigid plastics material. A tubular hub 31 is molded as an integral part of the flange 28 and projects through the center holes 26 within the discs 18. The flange 29 has a center hole 32 which receives the hub 31 with a light press-fit connection.

As apparent from FIGS. 5 and 6, when a plurality of discs 18 are assembled on the hub 31 to form the unit 15, each disc 18 serves to close the concentric capillary grooves or chambers 21 within each adjacent disc 18, and the flanges 28 and 29 effectively close the outwardly facing grooves 21 within the two end discs 18 within the stack. The closed grooves 21 function the same as capillary tubes. The grooves 21 and 23 may be filled with an ink simply by submerging the stack or unit 15 within an ink supply. As mentioned above, the radially extending grooves or passages 23 interconnect the concentric grooves 21 and also function as small capillary tubes for directing and controlling the flow of ink from the chambers or grooves 21 outwardly into the microporous ink applying sleeve 12.

From the drawing of the above description, it is apparent that an ink roller constructed in accordance with the present invention, provides desirable features and advantages. For example, the construction of each disc 15 provides substantial strength so that a stack or assembly of the discs form a rigid internal support for the sleeve 12. The discs 18 also provide for maximizing the storage capacity of the unit 15 for ink, and the closed capillary grooves 21 and 23 provide for a controlled transfer or metering of the ink from the ink retaining and storage unit 15 into the micro-porous sleeve 12. That is, the ink retained within the unit 15 flows by capillary action from the grooves 21 into the smaller grooves 23 and then into the even smaller pores within the sleeve 12 so that substantially all of the ink retained by the unit 15 is utilized. This controlled capillary ink flow also effectively replaces the ink removed from the sleeve 12 to assure that the ink applied by the roller 10 does not progressively diminish with use of the roller. The construction of the ink roller assembly 10 also provides for a simplified assembly, and the use of the separate discs 18 provides for minimizing the construction cost of the assembly in addition to providing all of the desirable features mentioned above. The ink roller assembly also eliminates any leakage of ink from the assembly when there is a relatively sudden change in temperature or atmospheric pressure.

It is also apparent that the basic principle of the invention may also be used for applying a liquid from a self-contained liquid storage reservoir. For example, a stack of thin plastic rectangular elements constructed with capillary cells or chambers similar to the discs 18, may be used for supplying ink to an adjacent pad of microporous material.

While the ink roller assembly and its method of construction herein described constitute a preferred embodiment of the invention, it is to be understood that the invention is not limited to the precise form of ink roller described, and that changes may be made therein without departing from the scope and spirit of the invention as defined in the appended claims.

The invention having thus been described, the following is claimed:

1. A method of producing an improved ink roller assembly adapted to provide a uniform application of ink over an extended period of use, comprising the steps of forming a plurality of generally circular thin discs each having a series of radially spaced and generally circumferentially extending capillary ink retaining chambers, arranging the discs in a stack to form a generally cylindrical ink retaining unit, inserting the ink retaining unit into a flexible sleeve of porous ink retaining material, forming on each of the discs a plurality of peripherally spaced and outwardly extending capillary passages connecting the corresponding chambers for directing a flow of ink from the chambers outwardly into the sleeve, and confining the ink retaining unit between a set of axially spaced flange members.

2. A method as defined in claim 1 including the step of forming each disc with a series of radially spaced generally concentric grooves forming the ink retaining chambers.

3. A method as defined in claim 1 or 2 wherein each of the discs is formed by deforming a thin sheet of plastics material.

4. A method as defined in claim 1 or 2 wherein the capillary passages are produced by forming outwardly extending generally radial grooves within the corresponding discs.

5. A method as defined in claim 1 or 2 wherein the capillary passages are formed with a depth less than the depth of the corresponding ink retaining chambers.

6. A method as defined in claim 1 or 2 wherein each disc is formed with a center hole, and including the steps of extending a hub member through the center holes, and connecting the hub member to the flange members.

7. A method of producing an improved ink roller assembly adapted to provide a uniform application of ink over an extended period of use, comprising the steps of forming a plurality of generally circular thin discs of plastics material with each disc having a generally uniform wall thickness and defining a series of radially spaced and generally circumferentially extending capillary ink retaining chambers, arranging the discs in a stack to form a generally cylindrical ink retaining unit, inserting the ink retaining unit into a flexible sleeve of porous ink retaining material, forming on each of the discs a plurality of peripherally spaced and outwardly extending capillary passages connecting the corresponding chambers for directing a flow of ink from the chambers outwardly into the sleeve, and confining the ink retaining unit between a set of axially spaced flange members.

* * * * *

UNITED STATES PATENT AND TRADEMARK OFFICE

CERTIFICATE OF CORRECTION

PATENT NO. : 4,534,094

DATED : August 13, 1985

INVENTOR(S) : John R. Kessler

It is certified that error appears in the above-identified patent and that said Letters Patent are hereby corrected as shown below:

Column 2, line 60, cancel "12" and insert --21--.

Claim 2, line 28, after "disc" insert --from a plastics material, and providing each disc--; same line, cancel "radially spaced".

Signed and Sealed this

Fifth Day of November 1985

[SEAL]

*Attest:*

*Attesting Officer*

DONALD J. QUIGG

*Commissioner of Patents and Trademarks*